US006009997A

United States Patent [19]

Deschenes et al.

[11] Patent Number: 6,009,997

[45] Date of Patent: Jan. 4, 2000

[54] LOOP FASTENER, FASTENER CLIP INCLUDING SAME AND LOOP FASTENER DISPENSING TOOL

[75] Inventors: Charles L. Deschenes, North Attleboro, Mass.; William J. Cooper, Woonsocket, R.I.; Clark L. Grendol, Sturbridge; Clinton N. Matthews, Stoughton, both of Mass.

[73] Assignee: Avery Denmson Corporation, Pasadena, Calif.

[ * ] Notice: This patent is subject to a terminal disclaimer.

[21] Appl. No.: 09/054,195

[22] Filed: Apr. 2, 1998

[51] Int. Cl.[7] ..... B65D 85/24

[52] U.S. Cl. ..... 206/346; 206/345

[58] Field of Search ..... 206/343, 345, 206/346, 338; 24/17 AP, 704.2, 16 PB; 292/318, 319, 321, 322

[56] References Cited

U.S. PATENT DOCUMENTS

| | | | |
|---|---|---|---|
| 3,931,667 | 1/1976 | Metser et al. | 206/346 |
| 4,198,772 | 4/1980 | Furutu | 292/318 |
| 4,240,183 | 12/1980 | Sumimoto et al. | 292/319 |
| 4,483,066 | 11/1984 | Akira | 29/811 |
| 4,559,676 | 12/1985 | Paradis | 24/16 PB |
| 4,854,014 | 8/1989 | Ueno | 24/16 PB |
| 5,116,091 | 5/1992 | Swift | 292/318 |
| 5,799,375 | 9/1998 | Fukami | 24/16 PB |

*Primary Examiner*—David T. Fidei
*Attorney, Agent, or Firm*—Kriegsman & Kriegsman

[57] ABSTRACT

A loop fastener well-suited for attaching tags to articles of commerce. In one embodiment, the loop fastener comprises a flexible filament having a first end and a second end. In addition, the loop fastener comprises a socket, the socket having a top surface and a bottom surface, the socket being provided with a channel and a flange, the channel extending transversely from the top surface to the bottom surface, the flange extending partially into the channel, the first end of the flexible filament being disposed on top of the top surface of the socket, the flexible filament extending away from the socket generally perpendicularly relative to the channel. The loop fastener further comprises an inserting element disposed at the second end of the flexible filament, the inserting element including a plug insertable into the channel and past the flange, the plug being engageable with the flange after the plug has been inserted therepast so as to keep the plug from being easily withdrawn back past the flange.

22 Claims, 15 Drawing Sheets

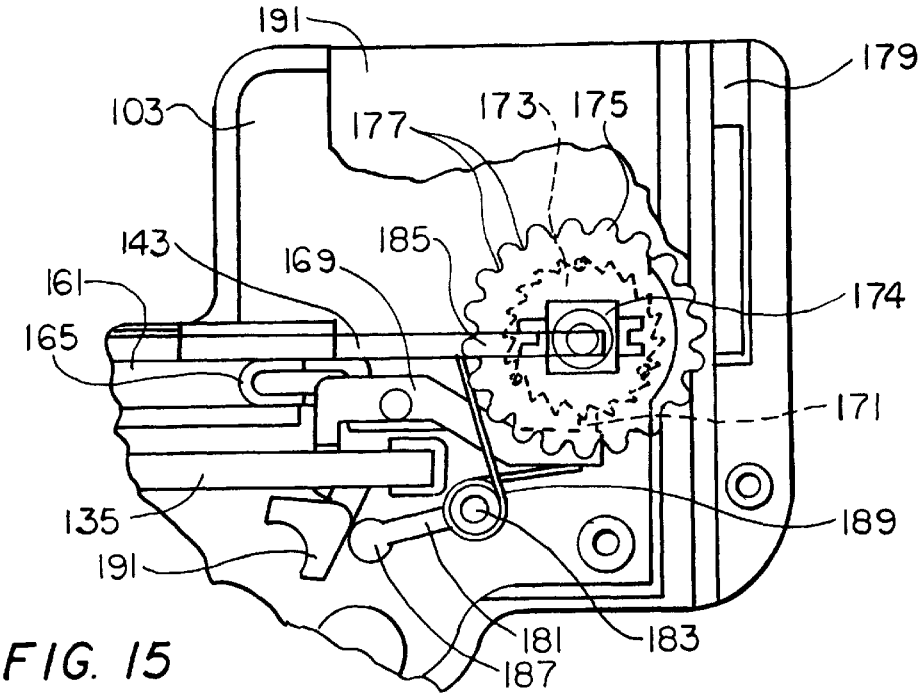
FIG. 15
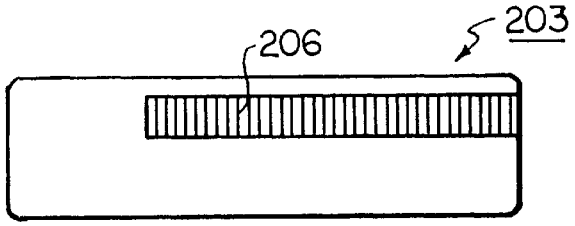
FIG. 16
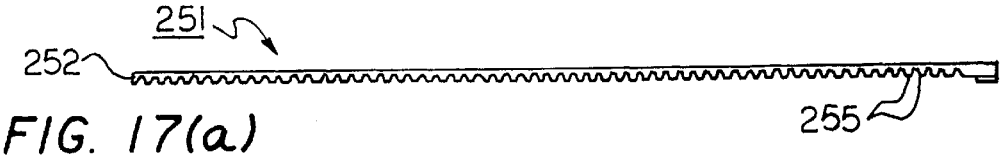
FIG. 17(a)
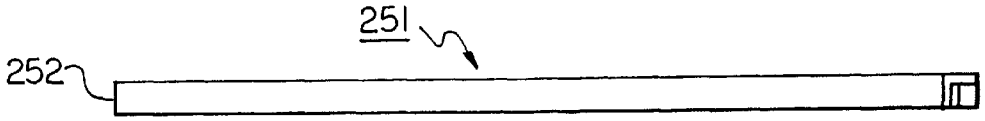
FIG. 17(b)
FIG. 17(c)
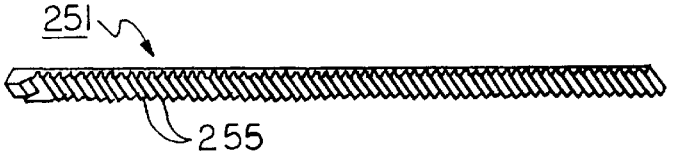
FIG. 17(d)
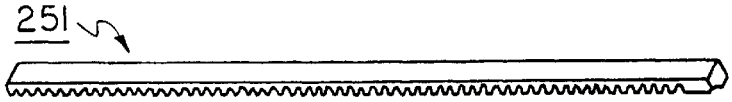

LOOP FASTENER, FASTENER CLIP INCLUDING SAME AND LOOP FASTENER DISPENSING TOOL

BACKGROUND OF THE INVENTION

The present invention relates generally to fasteners of the type that are commonly used to attach tags to articles of commerce and more particularly to loop fasteners of the aforementioned type.

Fasteners of the type commonly used to attach tags to articles of commerce are well-known and widely used. Typically, such fasteners are unitary structures made of molded plastic. One of the earlier types of such fasteners, which is still in widespread use today, includes an elongated, flexible filament having a cross-bar disposed at a first end thereof and either a paddle or a second cross-bar disposed at the second end thereof. In use, the cross-bar disposed at the first end is typically inserted first through a tag and then through the desired article of commerce, with the paddle or second cross-bar not being inserted into the article and being used to retain the tag on the fastener. Typically, a plurality of the aforementioned fasteners are fabricated together, either as part of a fastener clip or as continuously-connected fastener stock. The clip-type arrangement is disclosed, for example, in U.S. Pat. No. 3,103,666, inventor Bone, which issued Sep. 17, 1963, and which is incorporated herein by reference. An example of continuously-connected fastener stock is disclosed in U.S. Pat. No. 4,121,487, inventor Bone, which issued Oct. 24, 1978, and which is incorporated herein by reference.

As can be seen in the aforementioned '666 patent, in a clip-type arrangement, the cross-bars at the first ends of the respective fasteners are arranged parallel to one another, with each such cross-bar being connected to a common, perpendicularly-extending, runner bar by a corresponding severable connector. In addition, the paddles or cross-bars located at the second ends of the respective fasteners are also arranged parallel to one another. Such paddles or cross-bars at the second ends may or may not be connected to one another by severable connectors.

Although, in theory, an individual fastener from the above-described clip could be attached to a desired article by manually detaching the cross-bar at the first end of the fastener from the runner bar and then manually inserting said cross-bar through the desired article, it should be appreciated that the manual insertion of said cross-bar through most articles is very difficult to achieve in practice. This is in part because, to insert the cross-bar through an article (and/or through a hole in a tag), one must first pivot the cross-bar about the first end of the filament so that the cross-bar is placed in a generally parallel orientation relative to the filament and then, while maintaining said generally parallel orientation, insert the cross-bar through the article. However, due to the relatively small size of the cross-bar and the somewhat limited flexibility of the filament at its juncture with the cross-bar, said pivoting action is difficult to perform manually. The manual insertion of a cross-bar through an article is also made difficult by the fact that the cross-bar does not easily penetrate certain types of materials of which the article may be made. Accordingly, for the foregoing and other reasons, fasteners of the type described above, as well as fasteners of the type that make up continuously-connected fastener stock, have typically been dispensed using appropriate fastener dispensing tools.

Examples of fastener dispensing tools adapted for dispensing fasteners from fastener clips of the type described above are disclosed in the following U.S. patents, all of which are incorporated herein by reference: U.S. Pat. No. 3,103,666, inventor Bone, which issued Sep. 17, 1963; U.S. Pat. No. 4,611,740, inventor Kunreuther, which issued Sep. 16, 1986; U.S. Pat. No. 4,040,555, inventor Jenkins, which issued Aug. 9, 1977; U.S. Pat. No. 4,706,362, inventor Strausburg, which issued Nov. 17, 1987; U.S. Pat. No. 4,125,215, inventor Jenkins, which issued Nov. 14, 1978; U.S. Pat. No. 5,020,713, inventor Kunreuther, which issued Jun. 4, 1991; and U.S. Pat. No. 5,529,233, inventors Davignon et al., which issued Jun. 25, 1996.

Examples of fastener dispensing tools adapted for dispensing fasteners from continuously-connected fastener stock are disclosed in the following U.S. patents, all of which are incorporated herein by reference: U.S. Pat. No. 4,121,487, inventor Bone, which issued Oct. 24, 1978; U.S. Pat. No. 5,320,269, inventors Deschenes et al., which issued Jun. 14, 1994; U.S. Pat. No. 4,955,475, inventors McCarthy et al., which issued Sep. 11, 1990; U.S. Pat. No. 4,456,161, inventor Russell, which issued Jun. 26, 1984; U.S. Pat. No. 5,024,365, inventor Bourque, which issued Jun. 18, 1991; and U.S. Pat. No. 4,998,661, inventors Deschenes et al., which issued Mar. 12, 1991.

Whereas filamentary fasteners of the type described above having a cross-bar at a first end thereof and a paddle or a cross-bar at a second thereof are quite useful in attaching tags to many articles of commerce, such fasteners have limited tag-attaching utility for certain articles of commerce, such as sunglasses, which are not made of a material through which the cross-bar may be inserted and then retained thereagainst. For the foregoing reasons, as well as for other applications, various loop fasteners have been devised.

One type of loop fastener comprises a flexible filament having a longitudinally-extending plug at a first end thereof and a transversely-oriented socket at a second end thereof. (A related type of loop fastener includes a cross-bar instead of the aforementioned plug.) Typically, the socket is tubular in shape with opposing open ends and is provided with an apertured wall (or one or more flanges defining an opening of reduced size compared to the remainder of the socket interior) that divides the socket transversely into a pair of symmetric portions. Typically, the plug is in the form of a cone-shaped head and/or includes one or more spring tabs to enable the plug to be inserted through the apertured wall (or past the one or more flanges) from either end of the socket while, at the same time, keeping the plug from being easily withdrawn through the apertured wall after having been inserted therethrough. The spring tabs are typically arranged in a plane perpendicular to the longitudinal axis of the socket. The aforementioned type of loop fastener often further includes a stop, the stop being sized so as not to be insertable through the apertured wall and being positioned at such a distance from the plug so as to prevent the plug, once inserted through the apertured wall of the socket, from being pulled through the opposite open end of the socket to a point where it is accessible for tampering. Accordingly, once the plug has been inserted through the apertured wall (or past the one or more flanges), the fastener locks itself into a loop of a substantially fixed size. For this reason, such loop fasteners are often referred to in the art as "self-lockable loop fasteners."

Self-lockable loop fasteners are to be contrasted with other types of loop fasteners, such as cinching loop fasteners or cable ties (see U.S. Pat. No. 5,333,822, inventors Benoit et al., which issued Aug. 2, 1994 and which is incorporated herein by reference) and shoe-lasting loop fasteners (see U.S. Pat. No. 5,438,724, inventor Merser, which issued Aug.

8, 1995; U.S. Pat. No. 5,586,353, inventor Merser, which issued Dec. 24, 1996; and PCT Appln. No. PCT/US96/19479, filed Jun. 12, 1997, all of which are incorporated herein by reference).

Examples of self-lockable loop fasteners include the Secur-a-tach® family of fasteners commercially available from Avery Dennison Corporation, Framingham, Mass. Self-lockable loop fasteners are also described in the following U.S. patents and patent applications, all of which are incorporated herein by reference: U.S. Pat. No. 3,979,799, inventors Merser et al., which issued Sep. 14, 1976; U.S. Pat. No. 4,559,676, inventor Paradis, which issued Dec. 24, 1985; U.S. Pat. No. 4,183,567, inventor Bone, which issued Jan. 15, 1980; U.S. Design Pat. No. 266,484, inventor Bone, which issued Oct. 12, 1982; U.S. Design Pat. No. 262,436, inventor Bone, which issued Dec. 29, 1981; U.S. Pat. No. 4,245,374, inventor Suzuki, which issued Jan. 20, 1981; U.S. Pat. No. 4,240,183, inventors Sumimoto et al., which issued Dec. 23, 1980; commonly-assigned, presently pending U.S. patent application Ser. No. 08/829,992, inventors Merser et al., filed Apr. 2, 1997; and commonly-assigned, presently pending U.S. patent application Ser. No. 08/938,120, inventor Grendol, filed Sep. 26, 1997.

Self-lockable loop fasteners are typically mass-produced in assemblies of molded plastic, with each fastener of the assembly typically being attached by a severable connector to a common runner bar. Traditionally, to remove an individual self-lockable loop fastener from its assembly, the fastener is manually pulled away from the runner bar until the severable connector connecting the fastener to the runner bar breaks. Once separated from the remainder of the assembly, the plug end of the fastener is then manually inserted into its corresponding socket in the manner specified above.

Although the manual insertion of a plug into its corresponding socket is less difficult than the above-described manual insertion of a cross-bar through an article of commerce, it can readily be appreciated that such an activity, repeatedly performed for successive fasteners over extended periods of time, can be time-consuming, as well as physically and mentally taxing.

Accordingly, efforts have recently been expended in the development of tools that can be used both to detach individual self-lockable loop fasteners from fastener assemblies containing same and to insert the plug end of a fastener into its corresponding socket end. At the same time, efforts have also been expended in the development of improved self-lockable loop fasteners for use with such tools. Examples of the results of such efforts are disclosed in the following documents, all of which are incorporated herein by reference: U.S. Pat. No. 5,501,002, inventor Fukami, which issued Mar. 26, 1996; U.S. Pat. No. 4,483,066, inventor Akira, which issued Nov. 20, 1984; U.S. Pat. No. 4,536,933, inventor Furutsu, which issued Aug. 27, 1985; U.S. patent application Ser. No. 08/649,373, inventors Hirai et al., filed May 17, 1996; PCT Application No. PCT/US97/17687, inventor Hirai, filed Sep. 30, 1997; and PCT Application No. PCT/US97/17688, inventors Fukami et al., filed Sep. 30, 1997.

Commercial embodiments of the fastener assembly (also referred to herein as a "fastener clip") and of the fastener attaching tool of PCT Application Nos. PCT/US97/17687 and PCT/US97/17688, respectively, have been marketed by J. E. Kabushiki Kaisha (Tokyo, Japan) under the trademarks PYLON loop pin and PYLON loop connector, respectively. Although the aforementioned fastener clip and fastener attaching tool have worked generally satisfactorily, the present inventors have observed certain shortcomings therewith. One such shortcoming is the occasional jamming of fasteners in the tool during the dispensing thereof. Another such shortcoming is the occasional difficulty in retaining a tag on the needle of the tool as a fastener is dispensed by the tool through the tag.

SUMMARY OF THE INVENTION

It is an object of the present invention to provide a novel loop fastener.

According to one feature, the loop fastener of the present invention includes, among other things, (i) a flexible filament having a first end and a second end and (ii) a socket, said socket having a top surface and a bottom surface, said first end of said flexible filament being disposed on top of said top surface of said socket, said socket being provided with a channel, said channel extending transversely from said top surface to said bottom surface, said flexible filament extending away from said socket generally perpendicularly relative to said channel.

According to another feature, the loop fastener of the present invention includes, among other things, (i) a flexible filament having a first end and a second end and (ii) an inserting element disposed at said second end of said flexible filament, wherein each of said flexible filament and said inserting element has a longitudinal axis and wherein the respective longitudinal axes of said flexible filament and said inserting element are off-axis.

According to yet another feature, the loop fastener of the present invention includes, among other things, (i) a flexible filament having a first end and a second end, said flexible filament being bent prior to its being used, (ii) a socket, said socket being disposed at said first end of said flexible filament, said socket being provided with a channel, and (iii) an inserting element disposed at said second end of said flexible filament, said inserting element including a plug insertable into said channel.

According to still another feature, the loop fastener of the present invention includes, among other things, (i) a flexible filament having a first end and a second end, and (ii) a socket, said socket being disposed at said first end of said flexible filament, said socket being generally octagonal in cross-sectional shape.

It is another object of the present invention to provide a novel fastener clip.

According to one feature, the fastener clip of the present invention includes (a) at least one loop fastener, said loop fastener comprising (i) a flexible filament having a first end and a second end, (ii) a socket, said socket having a top surface and a bottom surface, said socket being provided with a channel and a flange, said channel extending transversely from said top surface to said bottom surface, said flange extending partially into said channel, said first end of said flexible filament being disposed on top of said top surface of said socket, said flexible filament extending away from said socket generally perpendicularly relative to said channel, and (iii) an inserting element disposed at said second end of said flexible filament, said inserting element including a plug insertable into said channel and past said flange, said plug being engageable with said flange after said plug has been inserted therepast so as to keep said plug from being easily withdrawn from said channel back past said flange; (b) a first runner bar, said first runner bar being severably connected to said socket; and (c) a second runner bar, said second runner bar being severably connected to said inserting element.

According to another feature, the fastener clip of the present invention includes (a) a first loop fastener, said first loop fastener comprising (i) a flexible filament having a first end and a second end, (ii) a socket, said socket being provided with a channel and a flange, said flange extending partially into said channel, said socket being generally octagonal in cross-sectional shape, and (iii) an inserting element disposed at said second end of said flexible filament, said inserting element including a plug insertable into said channel and past said flange, said plug being engageable with said flange after said plug has been inserted therepast so as to keep said plug from being easily withdrawn from said channel back past said flange; (b) a first runner bar, said first runner bar being severably connected to said socket; and (c) a second runner bar, said second runner bar being severably connected to said inserting element.

Preferably, with respect to both of the fastener clips described above, at least one of said first runner bar and said second runner bar is not disposed in the same plane as said first loop fastener. More preferably, both of said first runner bar and said second runner bar are not disposed in the same plane as said first loop fastener. Even more preferably, said first and second runner bars are not disposed in the same plane as said first loop fastener, and said first runner bar is spaced forwardly relative to the rear end of said socket and said second runner bar is spaced rearwardly relative to the front end of said inserting element. Still even more preferably, said fastener clips comprise a plurality of fasteners, said fasteners being arranged parallel to one another and not being disposed in the same plane as said runner bars, with said runner bars being spaced inwardly relative to the front and rear ends of the fasteners.

It is yet another object of the present invention to provide a novel fastener attaching tool.

According to one feature, the fastener attaching tool of the present invention includes a plate, said plate being shaped to include a hollow, slotted needle, the rear end of said hollow, slotted needle being spaced a short distance in front of the tool housing so that a tag or an item of similar thickness can be seated securely on said plate between said needle and said tool housing.

According to another feature, the fastener attaching tool of the present invention includes an arm assembly, said arm assembly being shaped to define a feed channel through which the socket portion of a fastener is adapted to travel, said channel being shaped complementary to said socket to maximize rotational alignment of said socket with an incoming plug.

According to yet another feature, the fastener attaching tool of the present invention includes an arm assembly, said arm assembly being provided with a stop that is matingly shaped to engage the rear end of the socket portion of a fastener so as to maximize translational alignment of said socket with an incoming plug.

According to still yet another feature, the fastener attaching tool of the present invention includes a belt, said belt being straight, flat and at a right angle to its longitudinal axis so as to maximize the contact area between the front end of said belt and the front end of the socket portion of a fastener of the type wherein the point of attachment of the flexible filament to the socket is on top of the socket, as opposed to being on the front end of the socket.

Additional objects, features, aspects and advantages of the present invention will be set forth, in part, in the description which follows and, in part, will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate preferred embodiments of the invention and, together with the description, serve to explain the principles of the invention. In the drawings wherein like reference numerals represent like parts:

FIG. 15 is an enlarged, fragmentary, left side view, broken away in part, of the loop fastener dispensing tool of FIG. 5, with the left portion of the tool not being shown for clarity;

FIG. 16 is a left side view of the rack shown in FIG. 10;

FIGS. 17(*a*) through 17(*d*) are top, side, front perspective and rear perspective views, respectively, of the flexible belt member shown in FIG. 11;

DETAILED DESCRIPTION OF PREFERRED EMBODIMENTS

Figure 1:
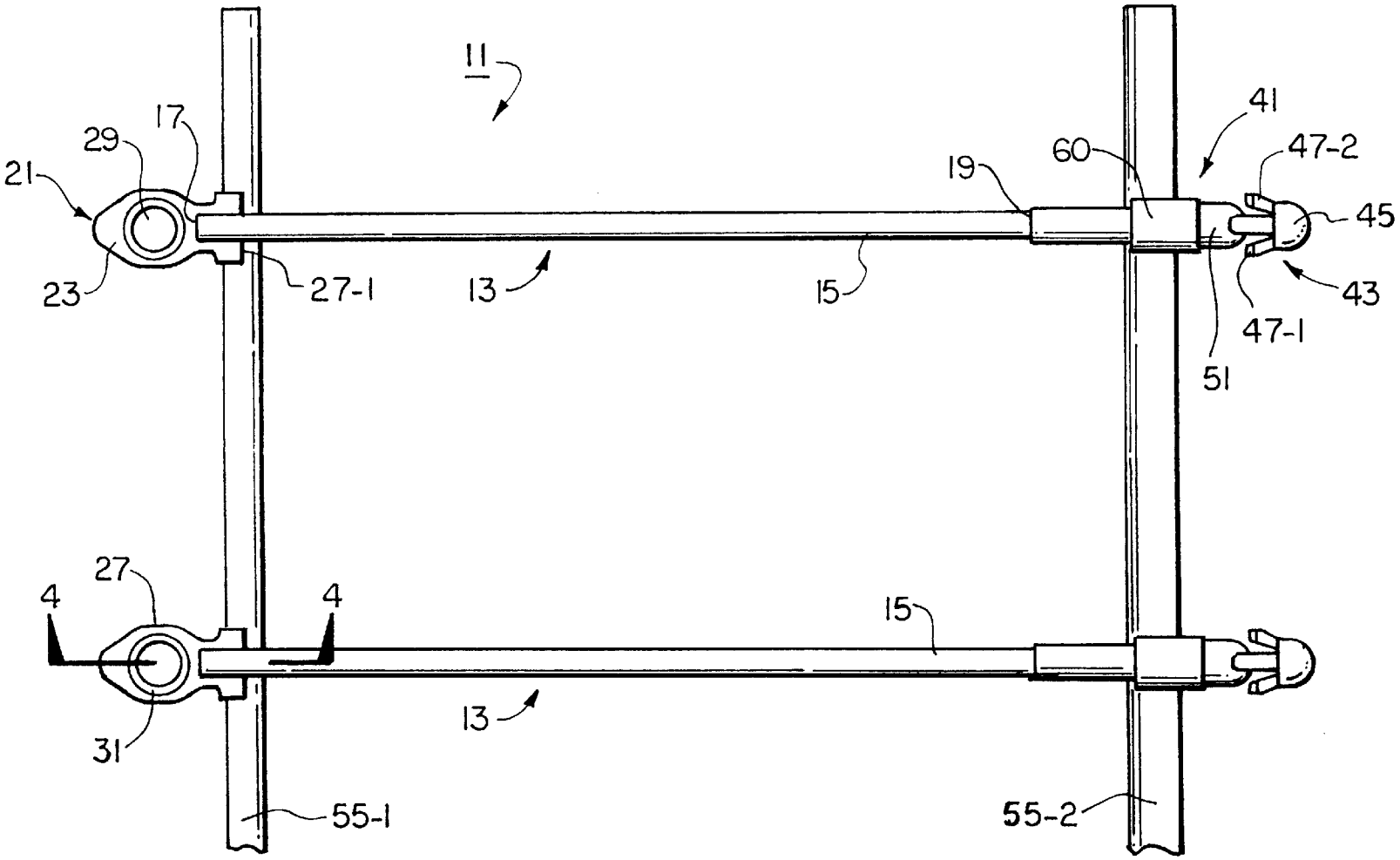
FIG. 1 is a fragmentary, top view of a first embodiment of a fastener clip constructed according to the teachings of the present invention.
Figure 3:
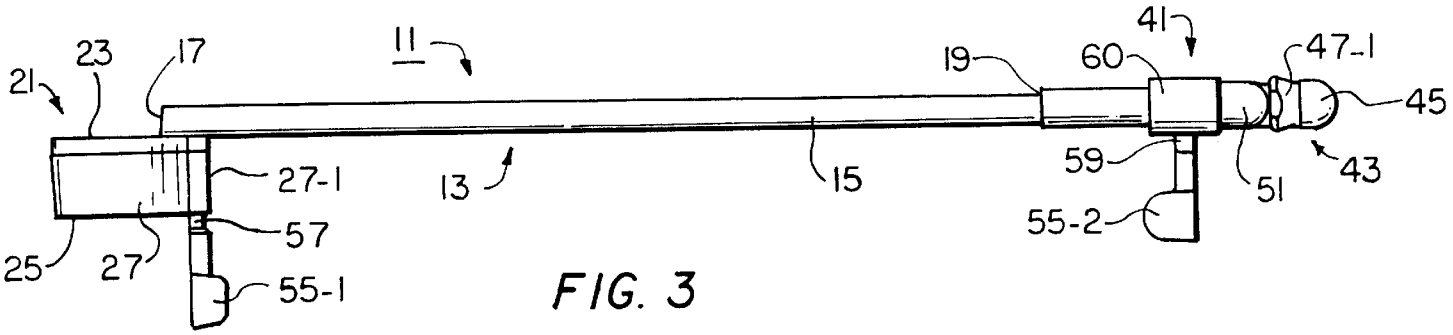
FIG. 3 is a left side view of the fastener clip of FIG. 1.

Referring now to FIGS. 1 through 4, there are shown various views of a first embodiment of a fastener clip constructed according to the teachings of the present invention, the fastener clip being represented generally by reference numeral 11.

Figure 2:
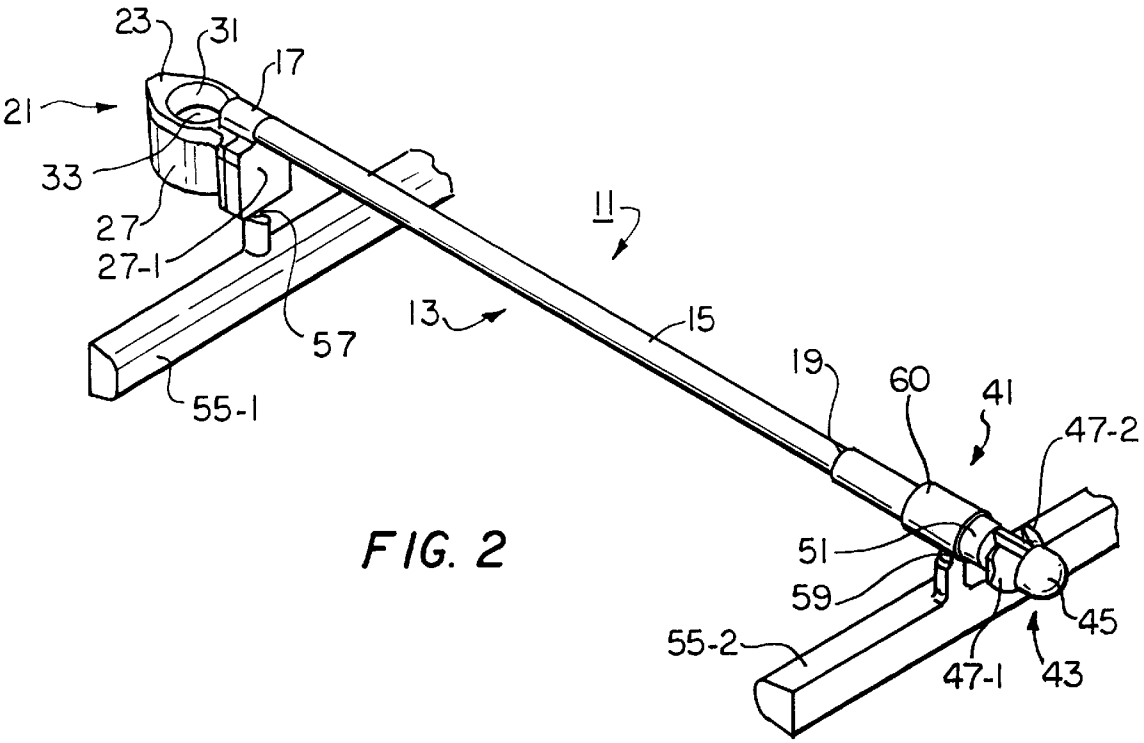
FIG. 2 is a fragmentary, front, top, left perspective view of the fastener clip of FIG. 1.
Figure 4:
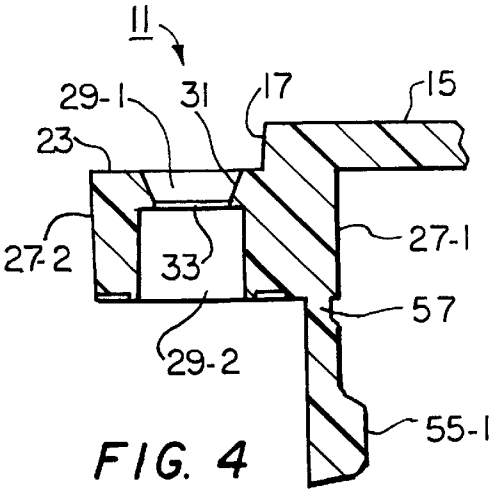
FIG. 4 is an enlarged, fragmentary section view taken along line 4 of FIG. 1.
Figure 5:
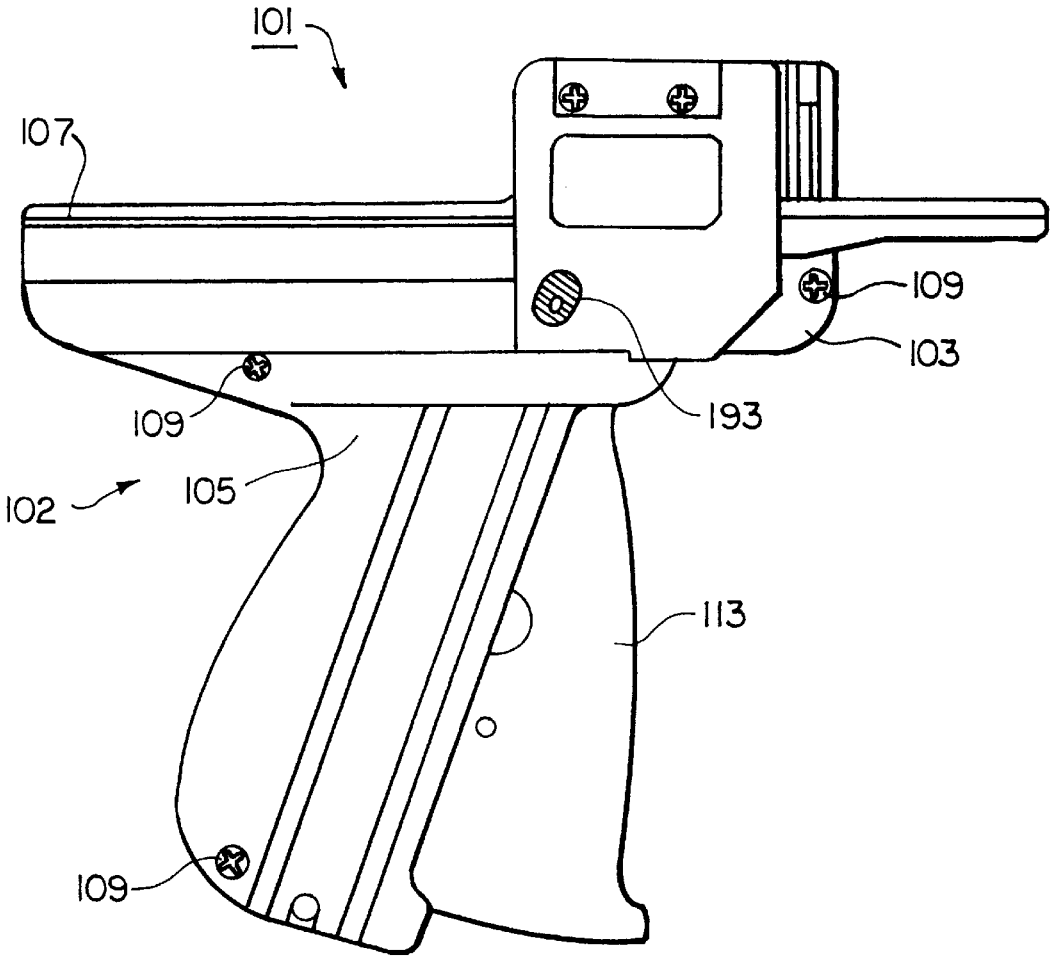
FIG. 5 is a left side view of a first embodiment of a loop fastener dispensing tool constructed according to the teachings of the present invention, said loop fastener dispensing tool being designed for use with the fastener clip of FIG. 1.
Figure 6:
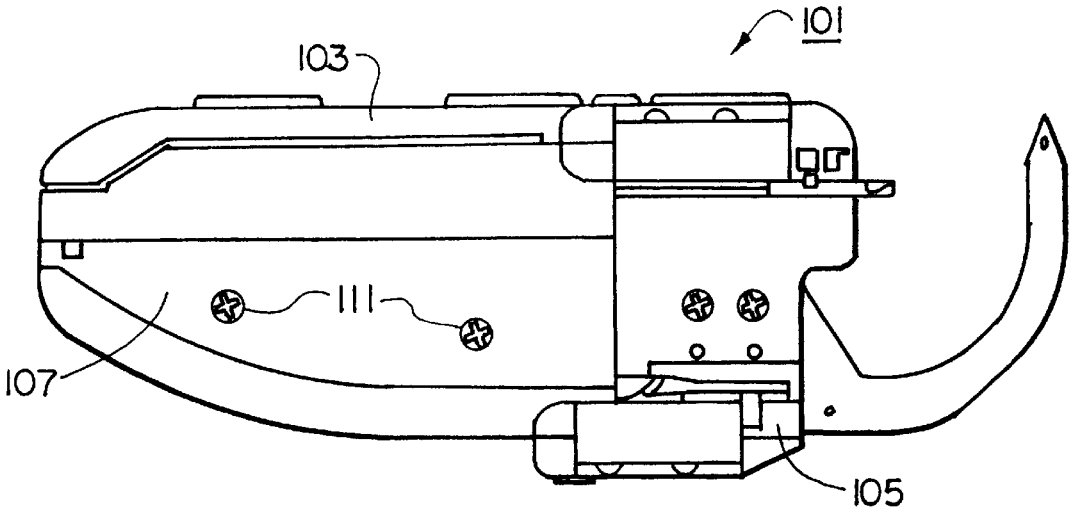
FIG. 6 is a top view of the loop fastener dispensing tool of FIG. 5.

Clip 11, which is preferably a unitary structure made of molded plastic, is shaped to include a plurality of identical fasteners 13. Although only one or two fasteners 13 of clip 11 are shown in FIGS. 1 and 2, it is to be understood that clip 11 preferably includes several (e.g., a few dozen or more) such fasteners.

Each fastener 13 is shaped to include a flexible filament 15, flexible filament 15 having a first end 17 and a second end 19.

Fastener 13 also includes a socket 21. Socket 21 has a top surface 23, a bottom surface 25 and a generally octagonally-shaped side surface 27. For reasons to be discussed below, first end 17 of flexible filament 15 is attached to the top of top surface 23, as opposed to being attached to the front end 27-1 of side surface 27.

Socket 21 is additionally provided with a channel 29, channel 29 extending transversely from top surface 23 to bottom surface 25 and extending generally perpendicularly to the longitudinal axis of filament 15. A conically-shaped, downwardly-tapering flange 31 extends partially into channel 29 from top surface 23, flange 31 dividing channel 29 into an upper portion 29-1 and a lower portion 29-2, upper portion 29-1 and lower portion 29-2 communicating with one another by an aperture 33 formed in flange 31.

Fastener 13 further includes an inserting element 41. Inserting element 41 is attached to second end 19 of flexible filament 15, the respective longitudinal axes of inserting element 41 and flexible filament 15 being coaxial. Inserting element 41 is shaped to include a plug 43 at its front end. Plug 43 comprises a head 45 and a pair of outwardly biasing spring tabs 47-1 and 47-2, each of spring tabs 47-1 and 47-2 being attached at one end thereof to head 45. Plug 43 is appropriately dimensioned so that it can readily be inserted downwardly through upper portion 29-1 of channel 29 and past flange 31 (as tabs 47-1 and 47-2 are pivoted inwardly due to their engagement with flange 31), but cannot easily be withdrawn back past flange 31 due to the abutment of the free ends of tabs 47-1 and 47-2 with the underside of flange 31 (once tabs 47-1 and 47-2 have cleared flange 31 and have pivoted back to their initial positions).

Inserting element 41 further comprises a stop 51, stop 51 being appropriately sized so as not to fit through aperture 33 of flange 31. Stop 51 is appropriately spaced from plug 43 so as to prevent tampering with spring tabs 47-1 and 47-2 once plug 43 has been completely inserted past flange 31. As can readily be appreciated, because stop 51 delimits forward insertion of plug 43 through channel 29 and because the combination of tabs 47-1 and 47-2 and flange 31 prevent withdrawal of plug 43 from channel 29, fastener 13 is a self-locking loop fastener.

Clip 11 further includes a pair of runner bars 55-1 and 55-2. Runner bars 55-1 and 55-2 are generally parallel to one another and are generally perpendicular to the respective filaments 15 of fasteners 13. Runner bar 55-1, which lies below the plane of fasteners 13, is connected to the respective sockets 21 of fasteners 13 by a corresponding plurality of severable connectors 57. Runner bar 55-1 is spaced forwardly relative to the rear ends of the respective sockets 21, with each connector 57 being attached to its corresponding socket 21 proximate to the front end 27-1 of side surface 27. Runner bar 55-2, which also lies below the plane of fasteners 13, is connected to the respective inserting elements 41 of fasteners 13 by a corresponding plurality of severable connectors 59. Runner bar 55-2 is spaced rearwardly relative to the front ends of the respective inserting elements 41, with each connector 59 being attached to its corresponding inserting element 41 at an enlarged portion 60 located rearwardly relative to its corresponding stop 51.

In use, one may manually separate an individual fastener 13 from its associated clip 11 by pulling a fastener 13 away from runner bars 55-1 and 55-2 until the severable connectors 57 and 59 connecting the fastener 13 to runner bars 55-1 and 55-2, respectively, break. One may then use the thus-separated fastener 13 to form a self-lockable loop (which may be used for the same types of applications as conventional self-lockable loop fasteners) by inserting plug 43 down through upper portion 29-1 of socket 21 and completely past flange 31. With plug 43 thus inserted completely past flange 31, tabs 47-1 and 47-2 prevent easy withdrawal of plug 43 back past flange 31, and stop 51 delimits continued movement of plug 43 through lower portion 29-2 of socket 21.

Although fasteners 13 may be manually dispensed from clip 11 and manually used in the manner described above, it can readily be appreciated that the manual performance of these steps can be, if repeated over time, mentally and/or physically taxing.

Referring now to FIGS. 5 through 11, there are shown various views of one embodiment of a loop fastener dispensing tool designed for use with fastener clip 11, said loop fastener dispensing tool being constructed according to the teachings of the present invention and being represented by reference numeral 101.

Tool 101, which is similar in many respects to the tool of herein-incorporated PCT Application No. PCT/US97/17688, comprises a hollow, gun-shaped housing 102, housing 102 including a right piece 103, a left piece 105 and a cover 107. Right piece 103, left piece 105 and cover 107 may be made of any suitable material, such as molded plastic. Right piece 103 and left piece 105 are joined together with three screws 109, and cover 107 and left piece 105 are joined together with a pair of screws 111.

Figure 9:
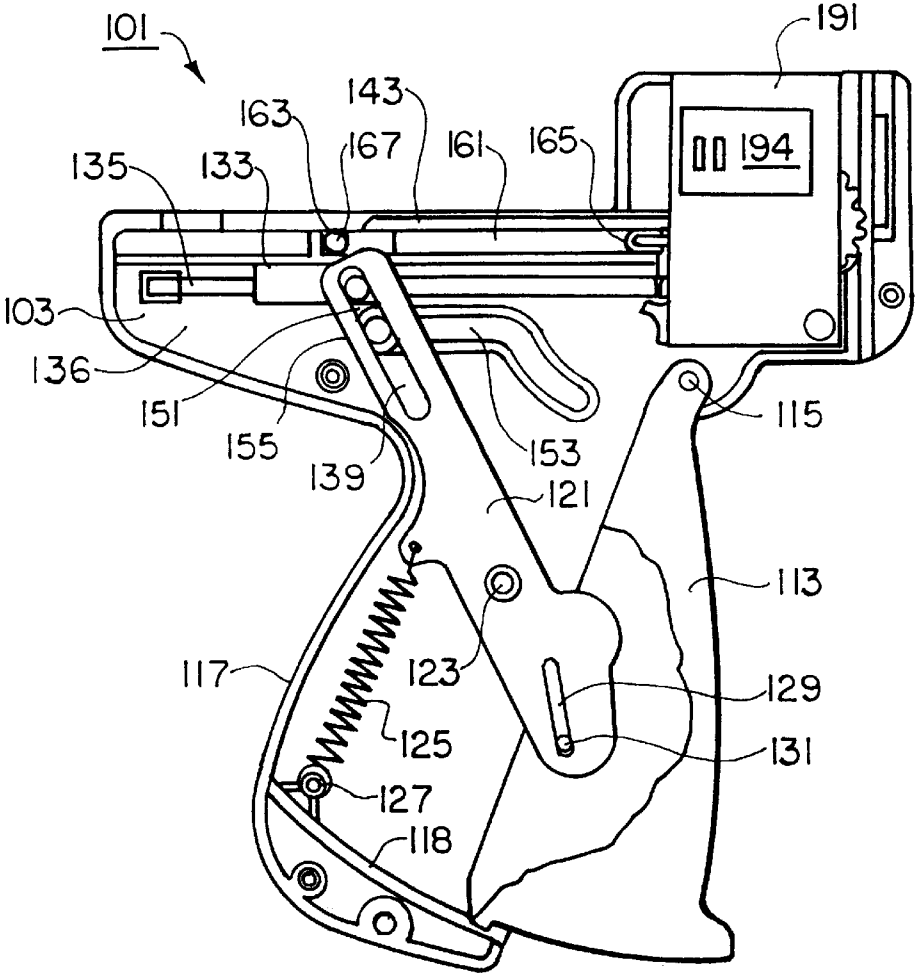
FIG. 9 is a left side view, broken away in part, of the loop fastener dispensing tool of FIG. 5, with the left portion of the tool not being shown for clarity.
Figure 7:
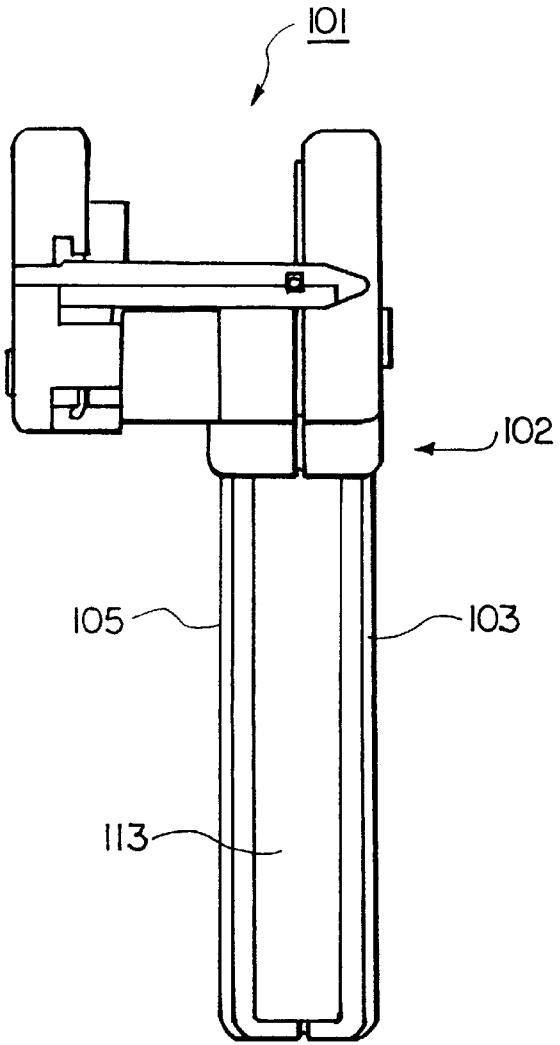
FIG. 7 is a front view of the loop fastener dispensing tool of FIG. 5.
Figure 8:
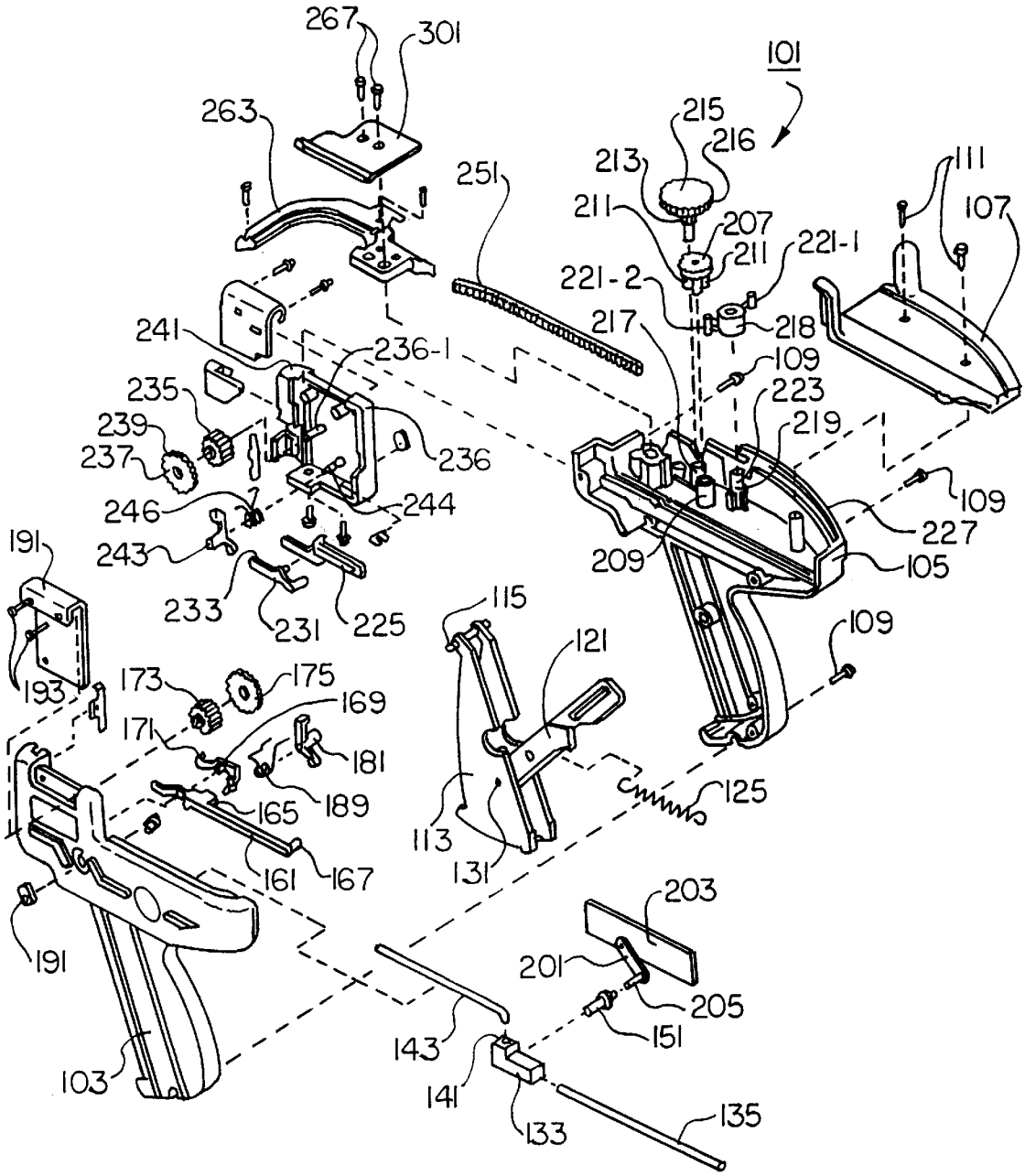
FIG. 8 is a partially exploded, top, rear, right, perspective view of the loop fastener dispensing tool of FIG. 5, the upper portion of the arm assembly not being shown.

Tool 101 also comprises a trigger 113, trigger 113 being pivotally mounted in housing 102 and extending partially therethrough for digital actuation. Trigger 113 may be made of molded plastic or another similarly suitable material. Referring to FIGS. 8 and 9, trigger 113 is pivotally mounted on a pin 115, pin 115 being mounted on right piece 103 and being appropriately positioned relative thereto so as to enable trigger 113 to be pivoted alternately towards and away from a grip region 117 of right piece 103. A drive guide 118, which is formed on the inside of right piece 103, is adapted to be slidingly contacted by a lower end face of trigger 113.

Figure 12:
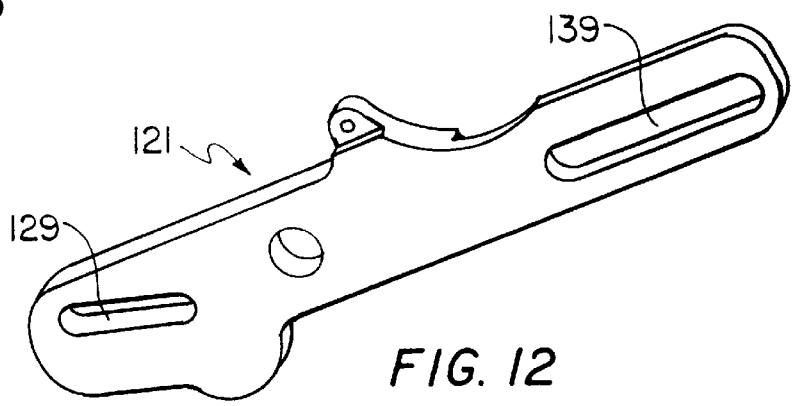
FIG. 12 is an enlarged perspective view of the link shown in FIG. 9.

Tool 101 further comprises a link 121 (shown also in FIG. 12), link 121 being mounted on a post 123 formed in right piece 103. Link 121, which may be made of molded plastic, is tension biased by a coiled spring 125, one end of which is secured to link 121 near its midpoint and the other end of which is secured to a post 127 formed on right piece 103 near drive guide 118. A slot 129 is formed in a lower end of link 121, and a pin 131 mounted on trigger 113 is adapted to slide back and forth across slot 129. In this manner, link 121 and trigger 113 are mechanically coupled to one another, and trigger 113 is normally biased forwardly under the effect of coiled spring 125.

Figure 13:
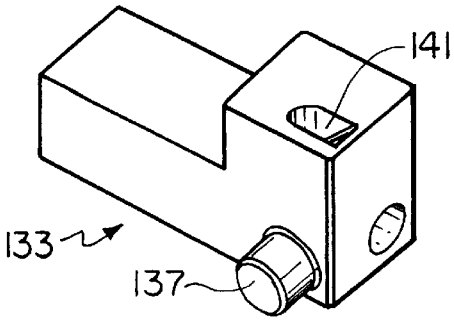
FIG. 13 is an enlarged perspective view of the piston carrier shown in FIG. 9.
Figure 14:
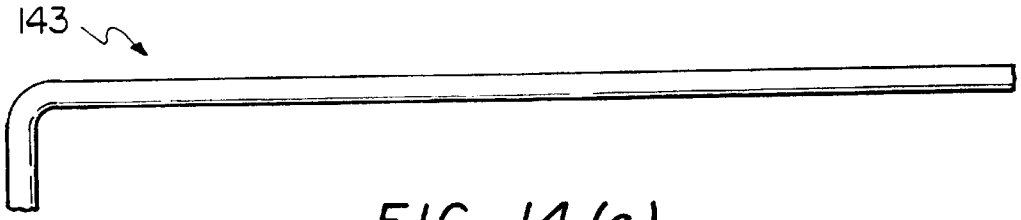
FIGS. 14(*a*) and 14(*b*) are enlarged left side and top views, respectively, of the piston shown in FIG. 9.
Figure 14:
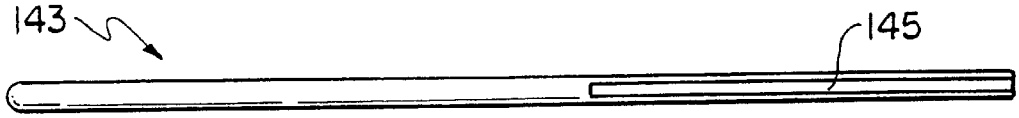
Figure 18A:
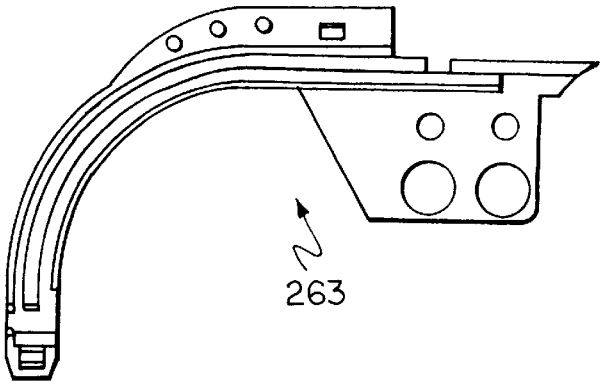
FIGS. 18(*a*) through 18(*e*) are top, bottom, side, top perspective and bottom perspective views, respectively, of the lower portion of the arm assembly shown in FIG. 10.
Figure 18B:
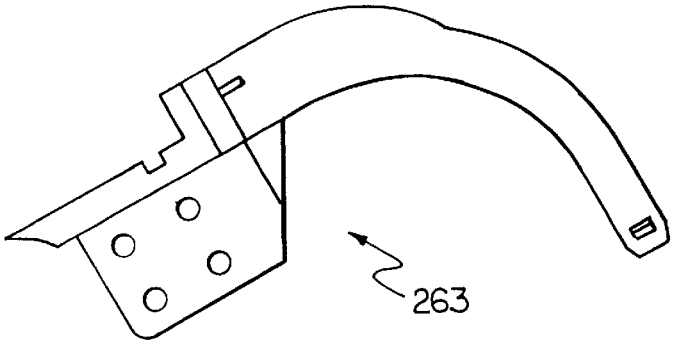
Figure 18D:
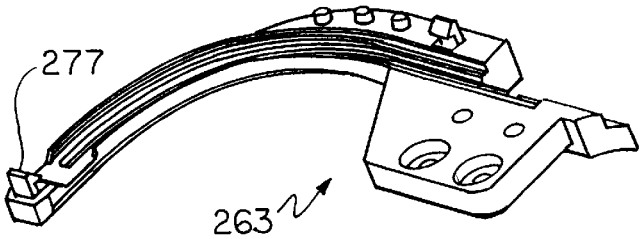
Figure 18C:
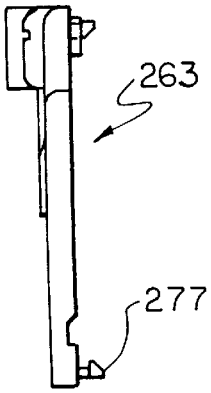
Figure 18E:
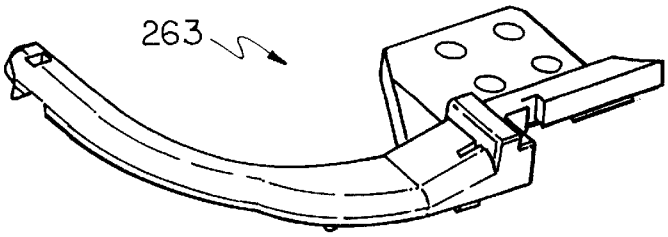
Figure 19A:
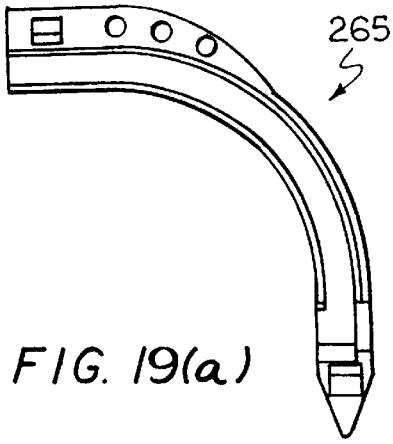
FIGS. 19(*a*) through 19(*e*) are bottom, top, side, bottom perspective and top perspective views, respectively, of the upper portion of the arm assembly shown in FIG. 10.
Figure 19B:
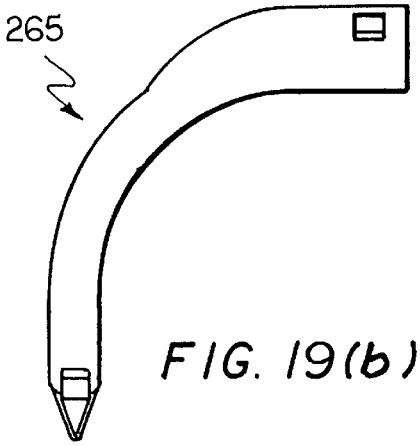
Figure 19C:
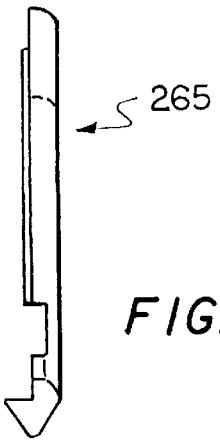
Figure 19D:
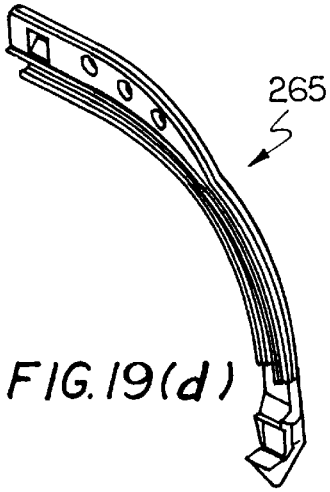
Figure 19E:
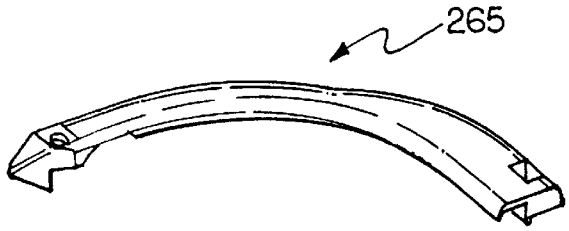

Tool 101 further comprises a piston carrier 133 (shown also in FIG. 13). Piston carrier 133, which may be made of molded plastic, is slidably mounted on a cylindrical post 135, post 135 being fixedly mounted at its ends onto and extending longitudinally across a barrel region 136 of right piece 103. Piston carrier 133 is shaped to include a pin 137, which projects from a side wall surface and which engages a slot 139 formed on the upper end of link 121. In this manner, link 121 and piston carrier 133 are mechanically coupled to one another. Piston carrier 133 is also shaped to include a receiving bore 141 formed on an upper surface thereof at a forward location. A rear end of a piston 143 (also shown in FIGS. 14(*a*) and 14(*b*)), which is bent into an L-shape, is mounted in bore 141. Piston 143, which may be made of metal, is tubular and is provided with a slit 145 that extends rearwardly from the front end thereof. As will hereinafter be described, when tool 101 is used to dispense fasteners 13 from a clip 11, the filament 15 of a fastener 13 passes through slit 145, with the rearwardmost end of slit 145 used to engage and to push forwardly on enlarged portion 60 of inserting element 41.

Tool 101 further comprises a cam 151, which may be made of molded plastic. Cam 151, which travels along a cam groove 153, is shaped to include a tubular post 155. Post 155 engages slot 139 of link 121 at a point below pin 137 and receives a pin of a link to be described below. In order to provide a sense of click at a final stage of operation, cam groove 153 is downwardly curved at its front end at a dull angle.

Tool 101 further comprises an inserting element feed bar 161. Feed bar 161, which may be made of molded plastic, is slidably retained in a slot 163 formed in right piece 103. As will hereinafter be described, feed bar 161 is used to actuate the feeding of the runner bar 55-2 of a clip 11 into tool 101 at a pitch of one fastener 13 per trigger stroke. Towards the front end of feed bar 161 there is provided a projection 165, projection 165 being engageable with the front end of piston carrier 133. In this manner, towards the end of the forward movement of piston carrier 133, feed bar 161 is engaged thereby and is moved forwardly a short distance. At the rear end of feed bar 161 there is provided a post 167, post 167 being engageable with a rear-facing surface of piston carrier 133. In this manner, towards the end of the return (i.e., rearward) movement of piston carrier 133, feed bar 161 is engaged thereby and is moved to the rear of slot 163.

As can be seen best in FIG. 15, a feed actuation member 169, which may be made of molded plastic, is mounted on the front end of feed bar 161. The front end of feed actuation member 169 is shaped to include a pawl 171. Pawl 171 is adapted to engage a ratchet 173 rotatably mounted on a post 174 formed on right piece 103. Ratchet 173, which may be made of molded plastic, is mechanically coupled to a feed gear 175. Feed gear 175, which may be made of metal, is shaped to define a plurality of notches 177, notches 177 being adapted to engage the severable connectors 79 of a clip 11 whose runner bar 55-2 has been inserted into a slot 179 formed in right piece 103. A stopper 181 for ratchet 173 is mounted on a post 183 formed on right piece 103, stopper 181 being free to turn about post 183 like a fulcrum. Stopper 181, which is bent in a generally dogleg-like configuration and which may be made of molded plastic, has an upper end 185 that is engageable with ratchet 173 and a lower end 187 that is actuated by and engageable with a releasing member 191 for permitting a clip 11 to be removed from tool 101. (A matching releasing member 193 (see FIG. 5) is disposed on left piece 105 of tool 101.) A spring 189 is also mounted on post 183, one end of spring 189 biasing feed actuation member 169 upwardly so that pawl 171 engages ratchet 173. Another end of spring 189 biases end 185 of stopper 181 to engage ratchet 173. A plate 191, which may be made of metal, is mounted on right piece 103 with a plurality of screws 193, plate 191 covering much of the above-described feeding mechanism. A guide plate 194 (see FIG. 9), which may be made of molded plastic, is mounted on top of plate 191, guide plate 194 serving to help keep piston 143 aligned with the inserting element 41 it is to engage.

Figure 10:
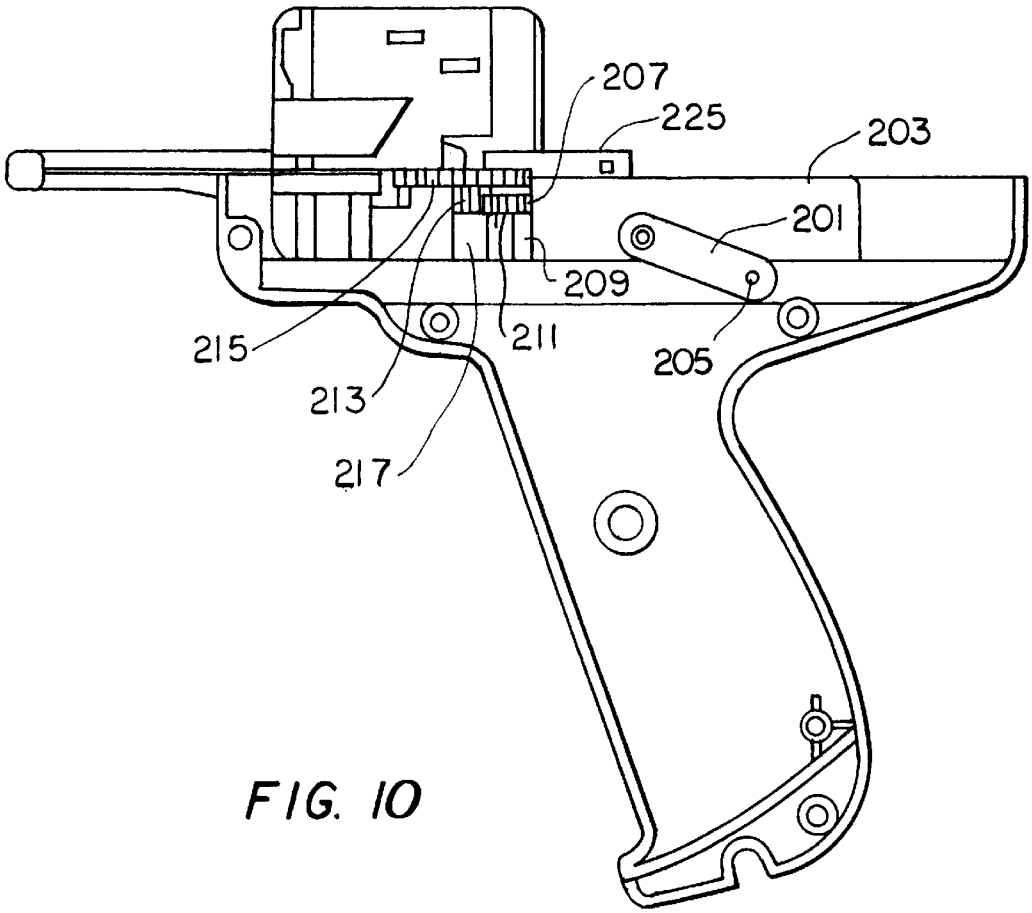
FIG. 10 is a right side view of the loop fastener dispensing tool of FIG. 5, with the housing cover and right portion of the tool not being shown for clarity.
Figure 11:
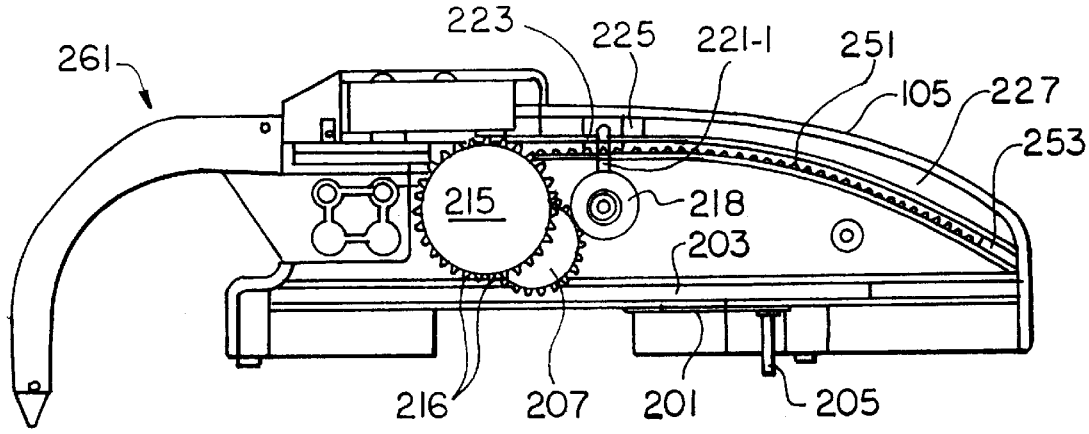
FIG. 11 is a top view of the loop fastener dispensing tool of FIG. 5, with the housing cover and needle plate not being shown for clarity.

Referring now to FIGS. 8, 10 and 11, there can more easily be seen the details of the various components located in the left portion of tool 101. As alluded to above, tool 101 includes a link 201, link 201 being pivotally mounted at one end thereof to a rack plate 203 slidably mounted in left piece 105 and being shaped to include at the opposite end thereof a pin 205. Link 201 may be made of metal, and rack plate 203 may be made of molded plastic. Pin 205 is retained in post 155 of cam 151. In this manner, rack plate 203 is mechanically coupled to cam 151 and is made to slide back and forth by actuation of trigger 113.

Rack plate 203 has integrally formed on its left side a rack 206 (see FIG. 16). Rack 206 is placed in engagement with a first gear 207, which may be made of molded plastic. Gear 207, which is rotatably mounted on a post 209 formed on left piece 105, is shaped to include a pair of downwardly extending projections 211. Gear 207 is placed in engagement with a notched shaft portion 213 of a second gear 215, gear 215 being rotatably mounted on a post 217 formed on left piece 105. Gear 215, which may be made of molded plastic, has a plurality of teeth 216 circumferentially disposed about its top portion. As can be appreciated, gear 215 is mechanically coupled to rack 206 through gear 207.

Tool 101 further includes a rotor 218, which is rotatably mounted on a shaft 219 formed on left piece 105. Rotor 218, which may be made of molded plastic, includes a pair of arms 221-1 and 221-2 which extend radially outwardly therefrom. The free end of arm 221-1 extends through a slot 223 defined by left piece 105, slot 223 being aligned with longitudinal axis of the barrel portion of left piece 105. The free end of arm 221-2 is adapted to be engaged alternately by projections 211 of gear 207 in such a way that, when a projection 211 of gear 207 contacts arm 221-2, a resulting rotational force is imparted to rotor 218. In this manner, arm 221-1 can be made to move back and forth across slot 223.

Tool 101 further includes a socket feed bar 225. Feed bar 225, which may be made of molded plastic, is slidably mounted in a slot 227 formed in left piece 105. Feed bar 225 is shaped to include a notch (not shown) located towards its rear end for receiving the free end of arm 221-1. In this manner, feed bar 225 is moved back and forth across slot 227 by arm 221-1. As will hereinafter be described, feed bar 225 is used to actuate the feeding of the runner bar 55-1 of a clip 11 into tool 101 at a pitch of one fastener 13 per trigger stroke. As seen best in FIG. 8, feed actuation member 231, which may be made of molded plastic, is mounted on the front end of feed bar 225. The front end of feed actuation member 231 is shaped to include a pawl 233. Pawl 233 is adapted to engage a ratchet 235 rotatably mounted on a post 236-1 formed on a side piece 236 of housing 102. Ratchet 235, which may be made of molded plastic, is mechanically coupled to a feed gear 237. Feed gear 237, which may be made of metal, is shaped to include a plurality of notches 239, notches 239 being adapted to engage the severable connectors 77 of a clip 11 whose runner bar 55-1 has been inserted into a slot 241 formed in side piece 236. A stopper 243 for ratchet 235, which is similar in structure and function to stopper 181 for ratchet 173, is mounted on a post 244 formed on side piece 236. A spring 246 is also mounted on said post, one end of said spring biasing feed actuation member 231 upwardly so that pawl 233 engages ratchet 235, the other end of said spring biasing one end of stopper 243 to engage ratchet 235.

Tool 101 further comprises a flexible belt member 251 (also shown in FIGS. 17(*a*) through 17(*d*)). Belt member 251, which may be made of a molded plastic, is disposed in a slot 253 formed in left piece 105. A plurality of teeth 255 are formed on one side of belt member 251, teeth 255 being placed in engagement with teeth 216 of gear 215. The front end 252 of belt member 251 is straight, flat and at a right angle to its longitudinal axis so as to maximize the contact area between the front end 252 of belt 251 and the front end 27-1 of a fastener 13. Moreover, because flexible filament 15 of fastener 13 is attached to the top of socket 21, as opposed to its front end, belt 251 is not likely to get jammed with filament 15.

Figure 20:
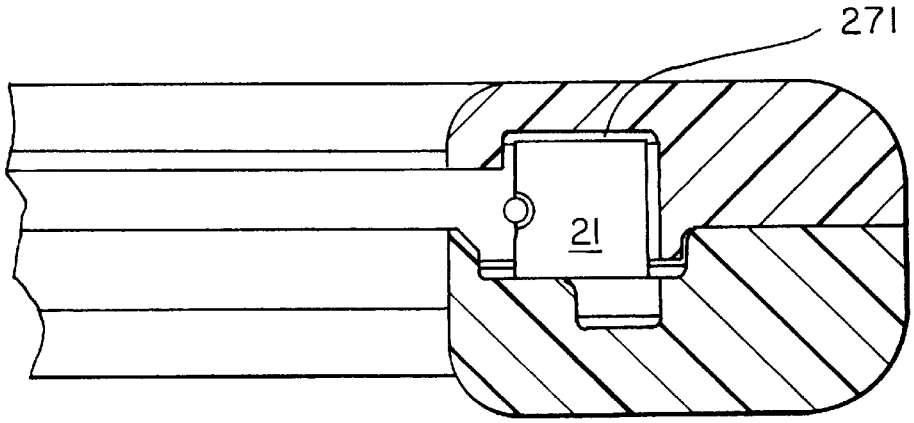
FIG. 20 is a section view of the arm assembly shown in FIG. 10, illustrating the complementary shape of the feed channel to a socket traveling therethrough.
Figure 21A:
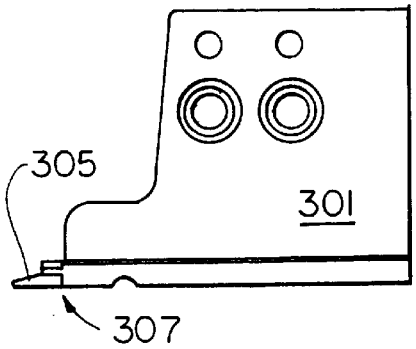
FIGS. 21(*a*) through 21(*d*) are top, bottom, top perspective and bottom perspective views, respectively, of the needle plate shown in FIG. 11.
Figure 21B:
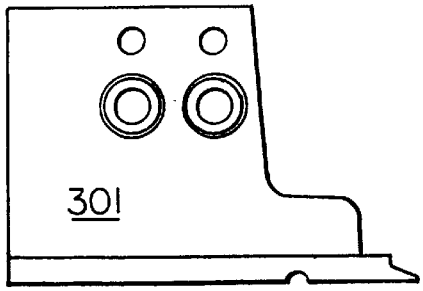
Figure 21C:
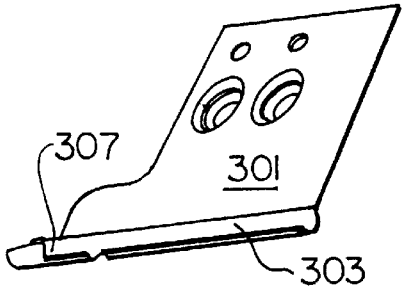
Figure 21D:
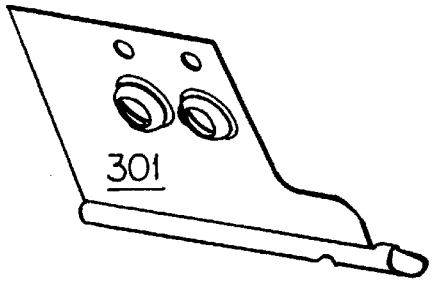

Tool 101 further comprises an arm assembly 261, arm assembly 261 comprising a lower portion 263 (also shown in FIGS. 18(*a*) through 18(*e*)) and an upper portion 265 (also shown in FIGS. 19(*a*) through 19(*e*)). Lower portion 263 is secured to left piece 105 by a plurality of screws 267, and upper portion 265 is secured to lower portion 265 by a plurality of screws 269. Lower portion 263 and upper portion 265 of arm assembly 261 jointly define a feed channel 271, feed channel 271 being aligned with slot 253. Feed channel 271 has a shape generally complementary to side wall 27 of socket 21 so as to minimize rotational movement of socket 21 about its longitudinal axis as socket 21 travels through feed channel 271 (see FIG. 20). In this manner, the likelihood of fastener 13 becoming jammed in tool 101 is reduced. Lower portion 263 and upper portion 265 also jointly define a slot 275 that communicates with feed channel 271 and that permits the filament 15 associated with the socket 21 traveling through feed channel 271 to extend therethrough. Lower portion 263 of arm assembly 261 is also shaped to include a stop 277 positioned a short distance from the end of feed channel 271. Stop 277 is matingly shaped to engage the rear end 27-2 of socket 21 so that socket 21, at the end of its passage through feed channel 271, will be properly positioned translationally to receive its corresponding inserting element 41. In this manner, the likelihood of fastener 13 becoming jammed in tool 101 is further reduced.

Figure 22:
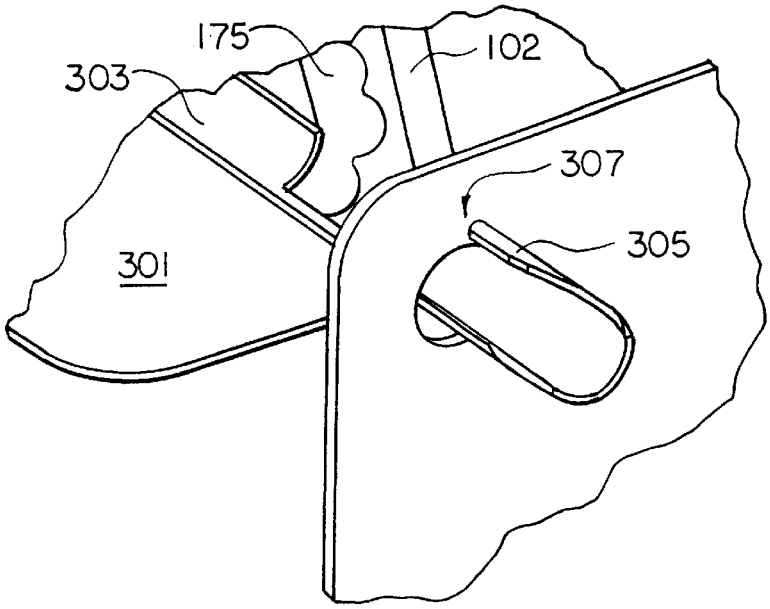
FIG. 22 is an enlarged, fragmentary, perspective view illustrating how the notch of the needle plate shown in FIG. 11 helps to retain a tag thereon.

Tool 101 further comprises a needle plate 301 (also shown in FIGS. 21(*a*) through 21(*d*)). Plate 301, which may be made of metal, is secured to lower portion 263 by screws 267. Plate is shaped to include a groove 303, which retains at least the front portion of and which guides piston 143. A blunt, hollow, slotted needle 305 is formed at the front of needle plate 301 in alignment with groove 303. A notch 307 of approximately 0.015 inch is provided at the rear of needle 305 (in front of the front end of right piece 103) to enable a tag or an item of similar thickness to be seated securely on needle plate 301 between needle 305 and the front of housing 102 (see FIG. 22). In this manner, an operator need not hold the tag on needle plate 301 during the dispensing of a fastener 13 from clip 11.

To use tool 101 to dispense a fastener 13 from clip 11, one first inserts runner bars 55-1 and 55-2 into slots 241 and 179, respectively, until the lowermost socket 21 and lowermost inserting element 41 are aligned with belt 251 and piston 143, respectively. One then begins to squeeze trigger 113, first causing piston 143 to capture the lowermost inserting element 41 and to push it forward through needle 301, thereby severing its connector 79 from runner bar 55-2. At the same time, the front end 252 of belt 251 engages the front end 27-1 of socket 21 and pushes it through feed channel 271, thereby severing its connector 77 from runner bar 55-1. Continued squeezing of trigger 113 first causes socket 21 to be advanced all the way through channel 271 until the rear end 27-2 of socket 21 is engaged by stop 277 and then causes plug 43 of inserting element 41 to be inserted through upper portion 29-1 and past flange 31 of socket 21. Release of trigger 113 causes the retraction of piston 143 and belt 251 and causes the rotation of feed gear 175 and feed gear 237 so as to advance runner bars 55-2 and 55-1 by one fastener each.

Figure 23A:
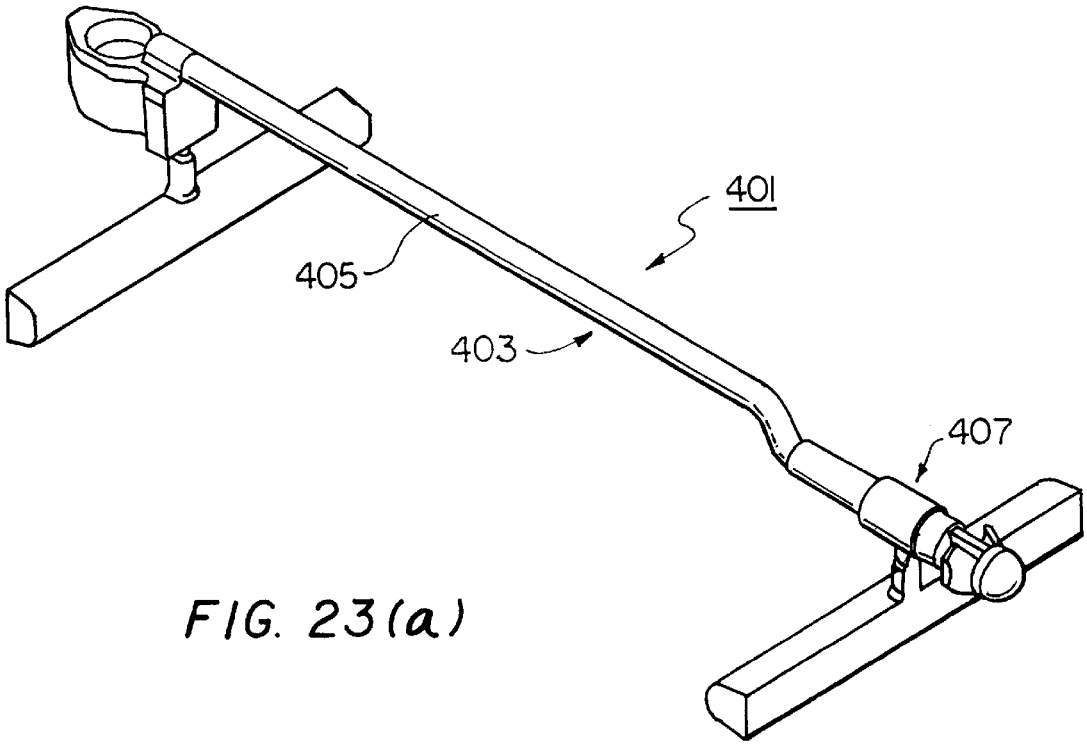
FIGS. 23(*a*) through 23(*c*) are perspective, top and side views, respectively, of a second embodiment of a fastener clip constructed according to the teachings of the present invention.
Figure 23B:
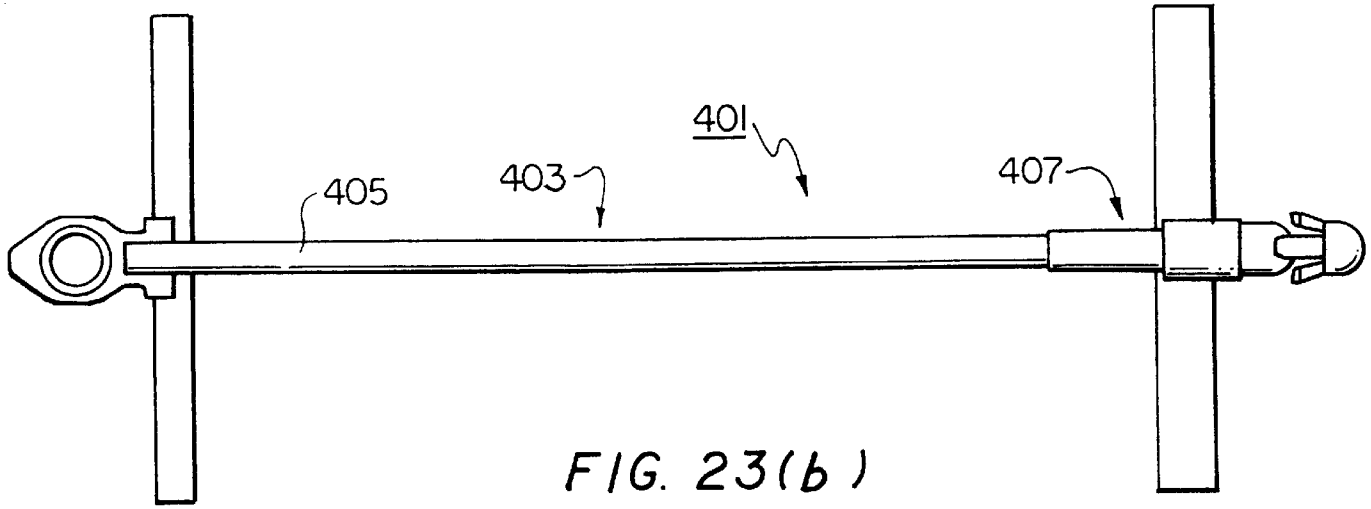
Figure 23C:
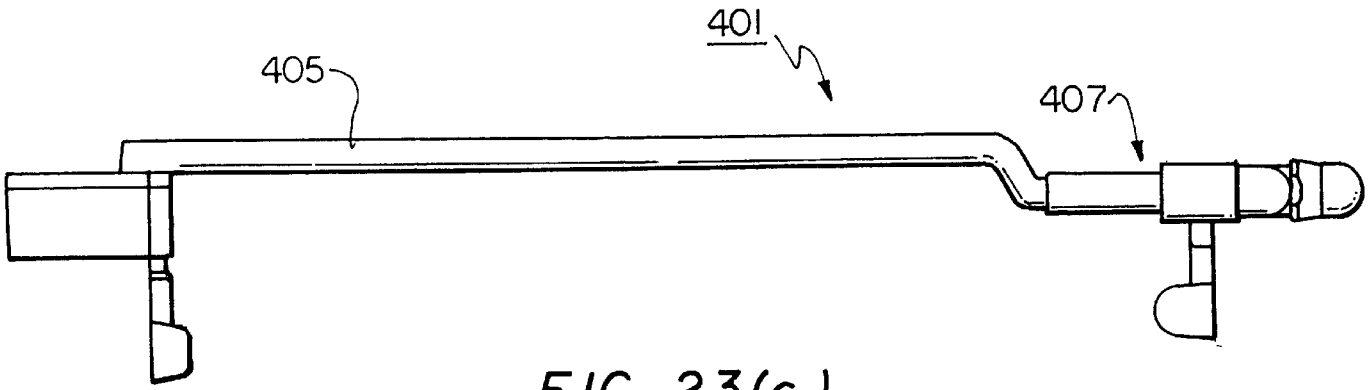

Referring now to FIGS. 23(*a*) through 23(*c*), there are shown various views of a second embodiment of a fastener clip constructed according to the teachings of the present invention, said fastener clip being represented generally by reference numeral 401.

Clip 401 is similar in structure and function to clip 11, the principal difference between the two clips being that clip 401 includes fasteners 403 whose filaments 405 are bent prior to use so that the inserting elements 407 are not aligned with the filaments 405.

Figure 24A:
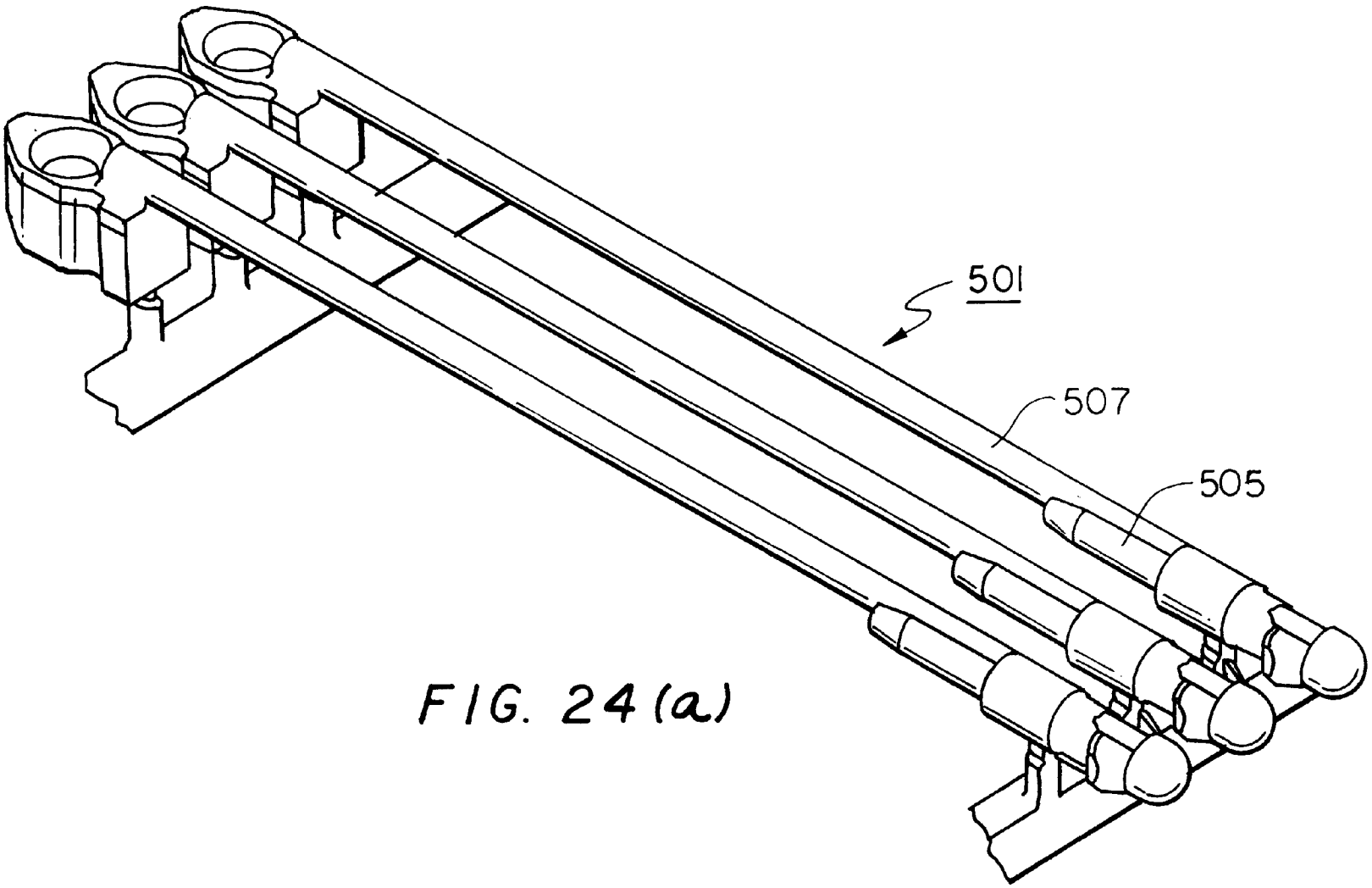
FIGS. 24(*a*) through 24(*c*) are perspective, top and side views, respectively, of a third embodiment of a fastener clip constructed according to the teachings of the present invention.
Figure 24B:
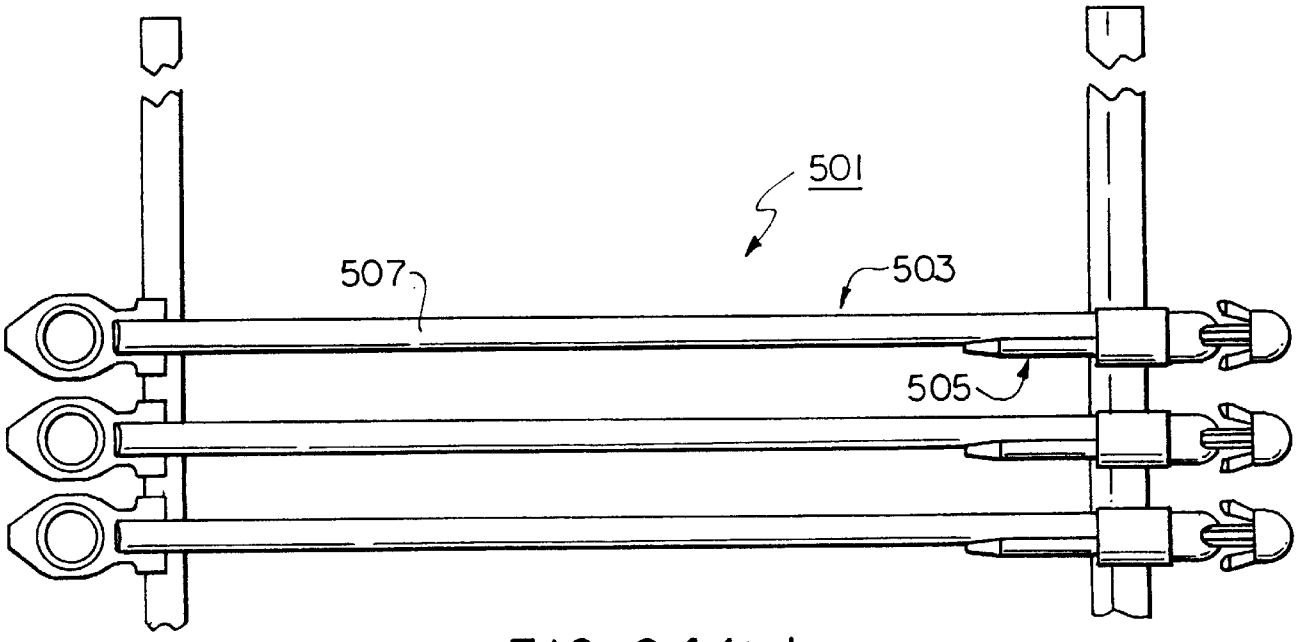
Figure 24C:
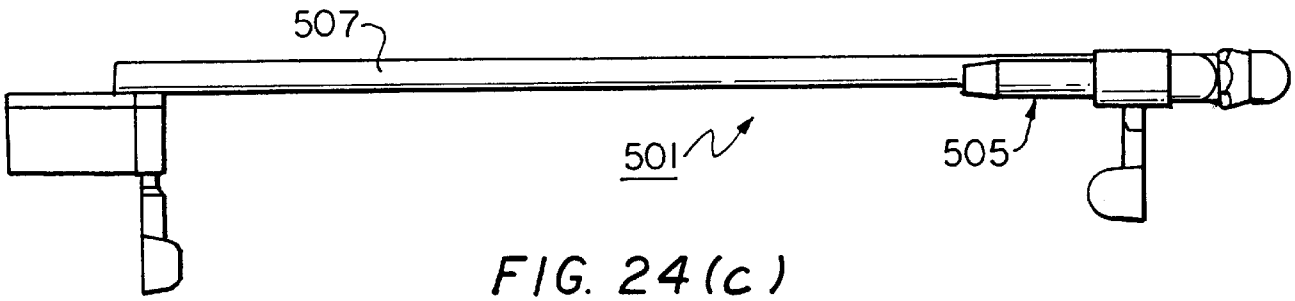

Referring now to FIGS. 24(*a*) through 24(*c*), there are shown various views of a third embodiment of a fastener clip constructed according to the teachings of the present invention, said fastener clip being represented generally by reference numeral 501.

Clip 501 is similar in structure and function to clip 11, the principal difference between the two clips being that clip 501, like clip 401, includes fasteners 503 whose inserting elements 505 are not aligned with (i.e., coaxial) their respective filaments 507.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A fastener clip comprising:

(a) a first loop fastener, said first loop fastener comprising (i) a flexible filament having a first end and a second end, (ii) a socket, said socket having a top surface and a bottom surface, said socket being provided with a channel and a flange, said channel extending transversely from said top surface to said bottom surface, said flange extending partially into said channel, said first end of said flexible filament being disposed on top of said top surface of said socket, said flexible filament extending away from said socket generally perpendicularly relative to said channel, and (iii) an inserting element disposed at said second end of said flexible filament, said inserting element including a plug insertable into said channel and past said flange, said plug being engageable with said flange after said plug has been inserted therepast so as to keep said plug from being easily withdrawn from said channel back past said flange;

(b) a first runner bar, said first runner bar being severably connected to said socket; and (c) a second runner bar, said second runner bar being severably connected to said inserting element.

2. The fastener clip as claimed in claim 1 wherein said loop fastener, said first runner bar and said second runner bar form a unitary structure made of molded plastic.

3. The fastener clip as claimed in claim 1 wherein each of said flexible filament and said inserting element has a longitudinal axis and wherein the respective longitudinal axes of said flexible filament and said inserting element are coaxial.

4. The fastener clip as claimed in claim 1 wherein each of said flexible filament and said inserting element has a longitudinal axis and wherein the respective longitudinal axes of said flexible filament and said inserting element are off-axis.

5. The fastener clip as claimed in claim 1 wherein said flexible filament is straight prior to its being used.

6. The fastener clip as claimed in claim 1 wherein said flexible filament is bent prior to its being used.

7. The fastener clip as claimed in claim 1 wherein said inserting part further comprises a stop for limiting forward movement of said plug past said flange.

8. The fastener clip as claimed in claim 1 wherein said socket has a generally octagonally-shaped side surface.

9. The fastener clip as claimed in claim 1 further comprising a second loop fastener, said second loop fastener being identical to said first loop fastener and comprising a second socket and a second inserting part, said second socket being severably connected to said first runner bar, said second inserting part being severably connected to said second runner bar.

10. The fastener clip as claimed in claim 9 wherein said first loop fastener and said second loop fastener are parallel to one another and lie in the same plane.

11. The fastener clip as claimed in claim 1 wherein at least one of the longitudinal axes of said first runner bar and said second runner bar is not disposed in the same plane as the longitudinal axis of said first loop fastener.

12. The fastener clip as claimed in claim 1 wherein both of the longitudinal axes of said first runner bar and said second runner bar are not disposed in the same plane as the longitudinal axis of said first loop fastener.

13. A fastener clip comprising:

(a) a first loop fastener, said first loop fastener comprising (i) a flexible filament having a first end and a second end, (ii) a socket, said socket having a top surface and a bottom surface, said socket being provided with a channel and a flange, said channel extending transversely from said top surface to said bottom surface, said flange extending partially into said channel, said first end of said flexible filament being disposed on top of said top surface of said socket, said flexible filament extending away from said socket generally perpendicularly relative to said channel, and (iii) an inserting element disposed at said second end of said flexible filament, said inserting element including a plug insertable into said channel and past said flange, said plug being engageable with said flange after said plug has been inserted therepast so as to keep said plug from being easily withdrawn from said channel back past said flange;

(b) a first runner bar, said first runner bar being severably connected to said socket; and (c) a second runner bar, said second runner bar being severably connected to said inserting element, wherein both of the longitudinal axes of said first runner bar and said second runner bar are not disposed in the same plane as the longitudinal axis of said first loop fastener and wherein said first runner bar is spaced inwardly relative to the end of said socket and wherein said second runner bar is spaced inwardly relative to the end of said inserting element.

14. A fastener clip comprising:

(a) a first loop fastener, said first loop fastener comprising (i) a flexible filament having a first end and a second end, (ii) a socket, said socket being provided with a channel and a flange, said flange extending partially into said channel, said socket having a generally octagonally-shaped side surface, and (iii) an inserting element disposed at said second end of said flexible filament, said inserting element including a plug insertable into said channel and past said flange, said plug being engageable with said flange after said plug has been inserted therepast so as to keep said plug from being easily withdrawn from said channel back past said flange;

(b) a first runner bar, said first runner bar being severably connected to said socket; and (c) a second runner bar, said second runner bar being severably connected to said inserting element.

15. The fastener clip as claimed in claim 14 wherein each of said flexible filament and said inserting element has a longitudinal axis and wherein the respective longitudinal axes of said flexible filament and said inserting element are off-axis.

16. The fastener clip as claimed in claim 15 wherein said flexible filament is straight prior to its being used.

17. The fastener clip as claimed in claim 15 wherein said flexible filament is bent prior to its being used.

18. The fastener clip as claimed in claim 14 wherein each of said flexible filament and said inserting element has a longitudinal axis and wherein the respective longitudinal axes of said flexible filament and said inserting element are coaxial.

19. The fastener clip as claimed in claim 14 wherein at least one of the longitudinal axes of said first runner bar and said second runner bar is not disposed in the same plane as the longitudinal axis of said first loop fastener.

20. The fastener clip as claimed in claim 19 wherein both of the longitudinal axes of said first runner bar and said second runner bar are not disposed in the same plane as the longitudinal axis of said first loop fastener.

21. The fastener clip as claimed in claim 19 wherein the longitudinal axis of said first runner bar is not disposed in the same plane as the longitudinal axis of said first loop fastener, said first runner bar being spaced inwardly relative to the end of said socket.

22. A fastener clip comprising (a) a first loop fastener. said first loop fastener comprising (i) a flexible filament having a first end and a second end, (ii) a socket, said socket being provided with a channel and a flange, said flange extending partially into said channel, said socket having a generally octagonally-shaped side surface, and (iii) an inserting element disposed at said second end of said flexible filament, said inserting element including a plug insertable into said channel and past said flange, said plug being engageable with said flange after said plug has been inserted therepast so as to keep said plug from being easily withdrawn from said channel back past said flange;

(b) a first runner bar, said first runner bar being severably connected to said socket; and (c) a second runner bar, said second runner bar being severable connected to said inserting element wherein at least one of the longitudinal axes of said first runner bar and said second runner bar is not disposed in the same plane as the longitudinal axis of said first loop fastener and wherein the longitudinal axis of said second runner bar is not disposed in the same plane as the longitudinal axis of said second loop fastener, said second runner bar being spaced inwardly relative to the end of said inserting element.

* * * * *